I-161 SR
10/15/85 OR 4,546,495

United States Patent [19]

Castillo

[11] Patent Number: 4,546,495

[45] Date of Patent: Oct. 15, 1985

[54] GLOVE APPARATUS FOR WEIGHTLIFTING PRESSES

[76] Inventor: David D. Castillo, 1202 S. 14th St., Phoenix, Ariz. 85034

[21] Appl. No.: 653,604

[22] Filed: Sep. 24, 1984

[51] Int. Cl.[4] ..... A41D 19/00

[52] U.S. Cl. ..... 2/161 A

[58] Field of Search ..... 2/16, 17, 20, 159, 160, 2/161 R, 161 A, 165, 166

[56] References Cited

U.S. PATENT DOCUMENTS

| | | | |
|---|---|---|---|
| 3,031,680 | 5/1962 | Compiano | 2/161 A |
| 3,065,472 | 11/1962 | Linnell | 2/161 A |
| 3,790,168 | 2/1974 | Hashimoto | 2/161 A |
| 3,863,271 | 2/1975 | Moroney | 2/161 A |
| 4,329,741 | 5/1982 | Bach | 2/161 A |

FOREIGN PATENT DOCUMENTS

| | | | |
|---|---|---|---|
| 0267325 | 11/1912 | Fed. Rep. of Germany | 2/20 |

*Primary Examiner*—Louis K. Rimrodt
*Assistant Examiner*—Joseph S. Machuga
*Attorney, Agent, or Firm*—H. Gordon Shields

[57] ABSTRACT

Weightlifting glove apparatus is disclosed which includes a tapered wedge extending from the heel of the hand inwardly toward the inside of the palm for use in weightlifting when presses are used. The wedge allows the hand to be aligned relatively straight with the ulna and radius when pressing. Due to the bone structure of the wrist, without such wedge the hands of the weightlifter rotate inwardly so that excess pressure is placed on the radius bone in the forearm and on the muscles of the wrist and hand. The wedge in the glove raises a weightlifting bar a sufficient distance to allow the hand to remain aligned with the wrist and forearm bones to relieve excess strain which causes pain and which may cause sprains.

5 Claims, 7 Drawing Figures

GLOVE APPARATUS FOR WEIGHTLIFTING PRESSES

BACKGROUND OF THE INVENTION

1. Field of the Invention

This invention relates to glove apparatus and, more particularly, to glove apparatus designed for use by weightlifters when doing presses.

2. Description of the Prior Art

It is well known and understood that gloves of various types are used by athletes for different athletic endeavors. For example, various types of gloves are used by golfers, by bowlers, and by baseball players. In addition, different types of training gloves are used by basketball players, bowlers, and other types of athletes where it is desired that the palm of a hand not contact a ball. Examples of various types of such gloves in the prior art are given below.

U.S. Pat. No. 1,915,617 discloses a type of glove used for golf. U.S. Pat. No. 2,554,991 discloses another type of glove used in golfing. U.S. Pat. No. 2,710,970 discloses another type of special glove which may be worn by a boxer, as when sparring, etc. The glove includes a bulge or padded portion across the palm and across the back of the wrist. U.S. Pat. No. 3,031,680 discloses a glove designed for bowling. U.S. Pat. No. 3,421,160 discloses another type of glove designed for bowling.

U.S. Pat. No. 3,496,573 discloses palm covering apparatus used for training purposes. The apparatus includes a wedge disposed over the palm so that the palm of the hand does not contact the ball, but rather the ball is limited in its contact area to the thumb and fingers of the user. The glove apparatus of the '573 patent is designed to promote finger control in such sports as basketball, football, volleyball, and baseball.

U.S. Pat. No. 3,501,773 discloses another type of training glove for athletes in which a wedge-shaped element is used to prevent contact between the ball and the palm of the user.

U.S. Pat. No. 3,583,704 discloses another type of bowling glove.

U.S. Pat. No. 3,606,614 discloses a padded glove designed for quarterbacks in football. The glove includes a raised pad portion disposed at the upper portion of the palm and adjacent to the base of the fingers.

U.S. Pat. No. 3,770,270 discloses another type of bowling glove.

U.S. Pat. No. 3,772,706 discloses yet another type of bowling glove which includes a compressible pad portion at the palm of the glove. The compressible portion acts as a spring to aid in the release of the bowling ball and to accelerate the ball upon its release.

Another type of bowling glove is disclosed in U.S. Pat. No. 3,835,472. A pocket is included in the palm of the glove to receive a wedge. The wedge may be oriented differently, depending on what type of spin or the amount of spin that a user wishes to place on the ball. In addition, a spring steel insert provides stiffening to assist the user in keeping the wrist straight.

U.S. Pat. No. 4,071,913 discloses a protective glove designed for skateboarders in which the finger and palm portion of the glove are padded for protection of the user.

U.S. Pat. No. 4,420,843 discloses a glove designed for a cyclist, with appropriate padding or lining designed to fit around the handlebar of a bicycle.

While the gloves discussed above in the various patents are all designed primarily for various types of athletic usages, none of them are designed to orient the hand in a particular manner for weightlifting purposes. The apparatus of the present invention is designed to be worn by a weightlifter when doing various kinds of presses in order to orient the hand correctly with respect to the wrist and forearms in order to minimize muscle strain and possible damage to muscles and bones.

SUMMARY OF THE INVENTION

The apparatus described and claimed herein comprises glove apparatus with a curved wedge extending from the heel of the hand inwardly towards and covering the palm of the hand, with the maximum thickness of the wedge at the outer end of the heel of the hand and the minimum thickness of the wedge inwardly at the inside of the palm of the hand in order to orient the hand in a manner that the hand is aligned with the wrist and the bones in the forearm when presses are performed.

Among the objects of the present invention are the following:

- To provide new and useful glove apparatus;
- To provide new and useful glove apparatus for weightlifters;
- To provide new and useful glove apparatus for bench pressing and military pressing of weights;
- To provide new and useful glove apparatus for aligning a user's hand with the user's wrists and forearms while weightlifting; and
- To provide new and useful glove apparatus having a wedge at the palm of the hand for orienting a user's hand with the user's wrists and forearms while grasping a weighted bar.

DESCRIPTION OF THE PREFERRED EMBODIMENT

Figure 1:
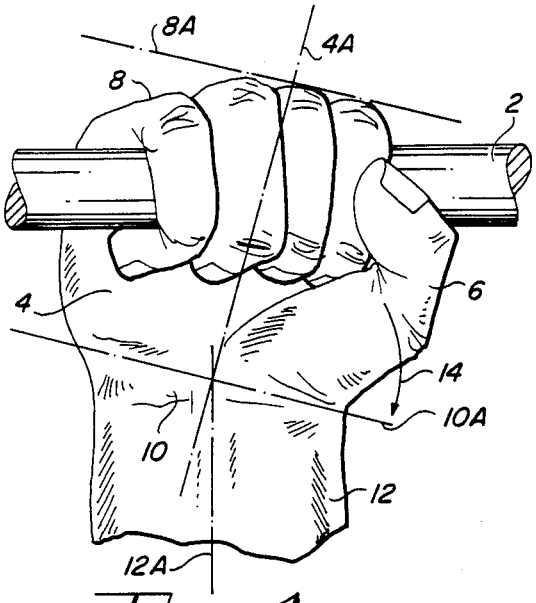
FIG. 1 (PRIOR ART)
FIG. 1 is a front view of a hand holding a bar and with the hand and wrist shown disposed at an angle other than perpendicular to each other.

FIG. 1 is a front view of a hand 4 holding a weightlifting bar 2 for press type weightlifting exercises. The hand 4 includes a thumb 6 and four fingers 8 which are wrapped around the bar 2. The hand 4 is connected to a wrist 10, which is in turn connected to a forearm 12.

There are four axis lines 4A, 8A, 10A, and 12A, shown in FIG. 1. The axis lines represent the various axes or imaginary lines which illustrate the tilt of the hand 4 under the strain of the weighted bar 2. The first axis is a hand axis 4A which generally represents the longitudinal axis of the hand 4. It will be noted that the hand axis 4A is generally perpendicular to two axes 8A and 10A. The axis 8A generally represents an axis or line across the top of the fingers 8. The axis 10A represents the lateral axis of the wrist 10. The axis 12A is the longitudinal forearm axis, and is generally parallel to the ulna and radius bones of the forearm 12.

The hand axis 4A is shown in FIG. 1 as generally disposed at a skew angle with respect to the forearm axis 12A. The wrist axis 10A and the finger alignment axis 8A remain perpendicular to the hand axis 4A, and, rather than being perpendicular to the forearm axis 12A, are also disposed at a skew angle with respect to the axis 12A.

The illustration of the axes 4A, 8A, and 10A shows the tilt of the hand inwardly, as indicated by the enlarged arrow 14. The thumb 6 is tilted toward the wrist 10 and towards the forearm 12. This tilt or movement of the hand 4 towards the forearm 12 causes a substantial strain on the muscles of the hand and of the wrist. The tilt is the result of the downward weight or force of the weighted bar 2 as grasped by the hand 4. The ultimate cause of the tilt of the hand is the uneven force exerted by the weighted bar 2 through the hand 4 due to the bone structure of the hand. The term "uneven" refers to the structure of the hand between the heel of the hand and the center of the palm for purposes of pressing against, or holding, the weighted bar 2.

Figure 2:
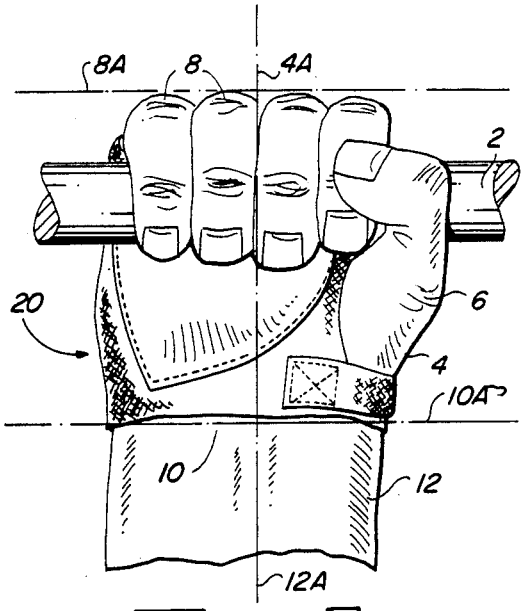
FIG. 2 is a view of a hand holding a bar and with the apparatus of the present invention on the hand.

FIG. 2 is a front view of the hand 4 holding the weighted bar 2, but with a glove 20 incorporating the present invention on the hand 4. The use of the glove 20 results in a changed configuration of the hand 4 and thus an alleviation of the problems illustrated in FIG. 1 with respect to the tilt movement of the hand, as illustrated by the various axes, and the consequent strain on the muscles and ligaments and bones of the hand 4.

In FIG. 2, it will be noted that the axis 4A of the hand is aligned with the axis 12A of the forearm. The finger axis 8A and the wrist axis 10A, which remain substantially perpendicular to the hand axis 4A, are now substantially perpendicular also to the forearm axis 12A. The alignment of the hand 4 with respect to the wrist 10 and to the forearm 12 substantially eliminates much of the stress on the ligaments, muscles, and bones that is caused by the twisting of the hand 4, as illustrated in FIG. 1.

Figure 3:
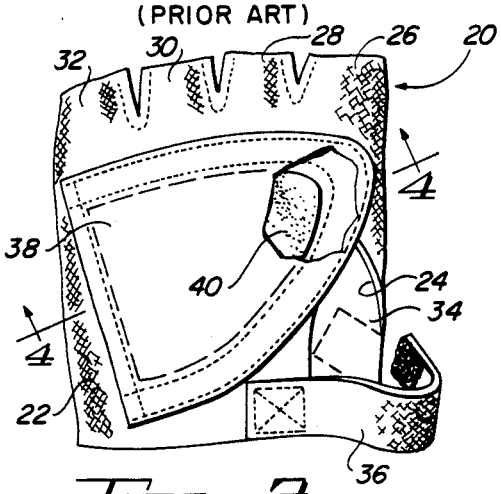
FIG. 3 is a plan view of the glove apparatus of the present invention.

FIG. 3 is a front view of the glove 20. The glove 20 includes a palm portion 22, and a thumb cutout area 24 at the side of the palm portion 22. At the upper portion of the glove 20, and thus at the upper portion of the palm 22, are four finger cutouts, including an index finger cutout 26, a middle finger cutout 28, a third finger cutout 30, and a little finger cutout 32. The glove is adapted to cover substantially the palm portion of the hand. The back of the hand may also be covered, if desired, by a back portion 34. The cutouts 24 . . . 32 allow the thumb and fingers to extend outwardly from the glove. If desired, of course, the glove 20 could also include the thumb and finger portions. However, for most weightlifters, the cutout areas for the thumb and fingers may be preferable.

The glove is secured to a user's hand by a wrist strap 36. The wrist strap 36 may be stitched (sewn) to the lower portion of the palm area 22 adjacent to the wrist. The outer end of the strap 36 may then be appropriately fastened to the back portion 34 by appropriate fastening elements, such as "Velcro" fastening material. If desired, the wrist portion of the glove 20 may be continuous, with an elastic band at the wrist. However, for comfort and fit, the wrist strap 36 may be preferred.

A wedge 40 is disposed on the palm 22 and is held in place within a pocket covering 38. The wedge 40 is adapted by appropriate configuration to cover substantially the entire palm portion of the hand 4 from the heel of the hand to the inner portion of the palm between the thumb and index finger.

Figure 4:
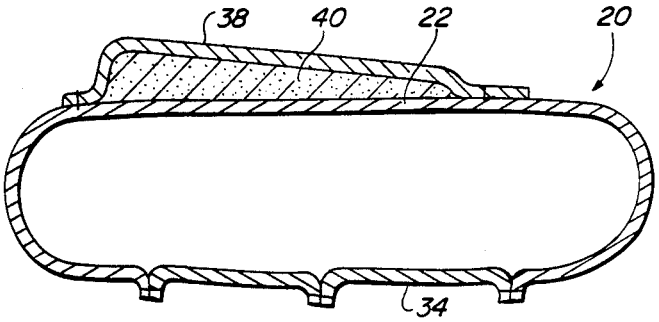
FIG. 4 is a view in partial section taken along line 4—4 of FIG. 3.
Figure 6:
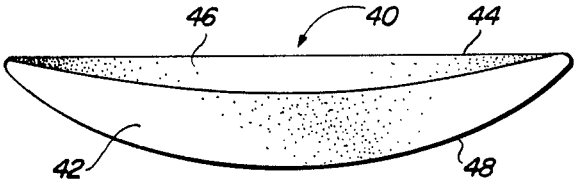
FIG. 6 is a view taken generally along line 6—6 of FIG. 5.
Figure 5:
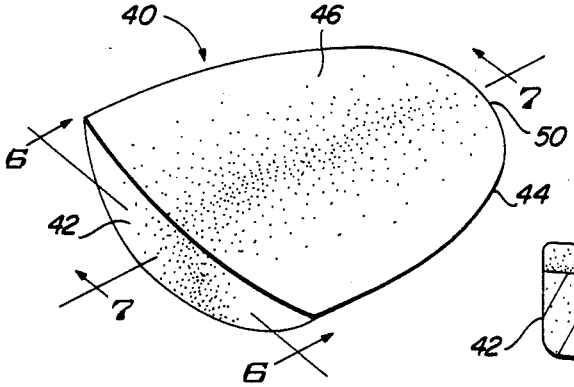
FIG. 5 is a perspective view of a portion of the apparatus of the present invention.
Figure 7:
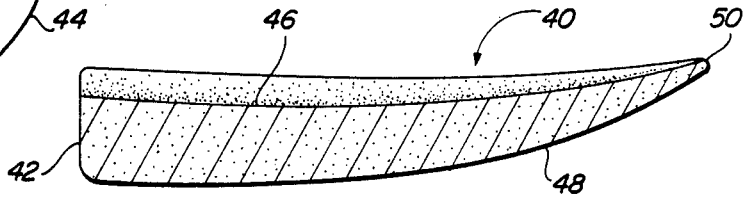
FIG. 7 is a view taken generally along line 7—7 of FIG. 5.

FIG. 4 is a view in partial section of the glove 20 taken generally along line 4—4 of FIG. 3. FIG. 5 is a perspective view of the wedge 40. FIG. 6 is an end view of the wedge 40 taken generally along line 6—6 of FIG. 5. FIG. 7 is a view in partial section of the wedge 40 taken generally along line 7—7 of FIG. 5, and comprising a side view through the wedge 40. For the following discussion, reference will primarily be made to FIGS. 3, 4, 5, 6, and 7.

The wedge 40 includes a generally flat base 42 which extends from the heel of the hand upwardly toward the palm. This is best shown in FIGS. 3 and 5. Extending between opposite ends of the base 42 there is a rounded edge 44 which defines the outer periphery of the wedge 40. The top or upper portion of the wedge 40 is a generally smoothly continuous concave area 46. There is a smoothly continuous tapering convex bottom 48 to the wedge 40 which extends from the base 42 outwardly toward a distal end 50. The distal end 50 is remote from the base 42.

As may be seen best from FIG. 7, the thickness of the wedge 42 varies from a maximum at the base 42 to a minimum at the distal end 50. The concave top 46 and the convex bottom 48 are somewhat parallel to each other, although there is, of course, a tapering toward each other from the base 42 to the distal end 50. The thickness of the wedge 40 is a minimum at the distal end 50, and both the concave top 46 and the convex bottom taper towards the distal end 50.

In usage, the wedge 42 is inserted into the pocket 38 so that the maximum thickness of the wedge 40, at the base 42, extends from the heel of the hand adjacent to the wrist upwardly to the top of the palm adjacent to the little finger. The thickness of the wedge then tapers from the base 42 inwardly across the palm, to the area of the palm between the thumb and the forefinger.

The tapering thickness of the wedge 40, as placed in a user's hand by the glove apparatus 20, compensates for the natural or inherent raising of the portion of the hand adjacent to the thumb as a fist is made, as when the hand 40 grasps the bar 2. When the thumb is disposed adjacent to the forefinger when the hand is made into a fist, there is a natural or inherent raising of the area of the hand at the base of the thumb, without a corresponding raising of the heel of the hand. The wedge 40 compensates for that inherent raising by increasing the thickness or height of the hand at the heel of the hand, or the outer portion of the hand, to allow the weighted bar 2 to be held by the hand, as shown in FIG. 2, with the axis of the forearm 12A and the longitudinal axis of the hand 4A aligned with each other. This hand and bar orientation, as indicated above, substantially lessens the strain on the muscles, ligaments, and bones of the hand, wrist, and forearm.

As may best be seen in FIGS. 3 and 5, the wedge 40 tapers in width from a maximum width at the base 42 to a minimum width at the distal end 50. The thickness and width of the wedge are correlated in that the maximum thickness is at the area of maximum width, and the minimum thickness is at the area of minimum width.

The wedge 40 is somewhat flexible so that it will curve or bend with the hand as the hand grasps the bar 2. The bar is disposed within the concave portion 46 of the wedge as the hand grasps and holds the bar. The greater flexibility of the wedge is thus between the base 42 and the distal end 50, and along the concave-convex axis of the wedge 50 so as to conform to the curvature of the grasping or holding fist or hand 4 and the bar 2.

While the principles of the invention have been made clear in illustrative embodiments, there will be immediately obvious to those skilled in the art many modifications of structure, arrangements, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What I claim is:

1. A glove for the hand of a weightlifter while grasping and lifting a bar, comprising, in combination:

a palm portion for covering substantially the entire palm of the weightlifter's hand;

wedge means disposed on the entire palm portion and extending across the palm portion from the heel of the hand to the inside edge of the hand between the thumb and the index finger, and including a smoothly concave upper portion and a smoothly convex lower portion.

2. The glove of claim 1 in which the wedge means further includes a tapering thickness extending from the heel of the hand to a minimum thickness at the inside edge of the hand.

3. The glove of claim 2 in which the wedge means further includes a base portion at the heel of the hand and defining the portion of maximum thickness.

4. The glove of claim 3 in which the wedge means further includes a distal end at the inside edge of the hand and remote from the base portion.

5. The glove of claim 4 in which the wedge means is flexible between the base portion and the distal end and along the concave and convex portions for conforming to the curvature of the weightlifter's hand as the bar is grasped and held.

* * * * *